United States Patent [19]

Shacklett, Jr. et al.

[11] 4,136,860

[45] Jan. 30, 1979

[54] METHOD AND APPARATUS FOR MANUFACTURE OF ROLLED INFORMATION LABEL

[75] Inventors: James H. Shacklett, Jr., 2025 Joshua Rd., Lafayette Hill, Pa. 19444; Charles W. Bittner, Cherry Hill, N.J.

[73] Assignee: James H. Shacklett, Jr., Lafayette Hill, Pa.

[21] Appl. No.: 774,521

[22] Filed: Mar. 4, 1977

[51] Int. Cl.[2] ..... 156 446; B65H 45/00

[52] U.S. Cl. ..... 270/61 R; 93/77 R; 93/84 TW

[58] Field of Search ..... 270/61 R, 94; 223/37; 93/84 R, 84 TW, 77 R, 94 R; 138/141, 151; 271/112, 103, 95; 156/184, 187, 193, 198, 446, 451, DIGS. 30–31

[56] References Cited

U.S. PATENT DOCUMENTS

| | | | |
|---|---|---|---|
| 2,601,984 | 7/1952 | Pope | 271/9 S |
| 2,610,556 | 9/1952 | Worth | 93/77 R |
| 3,711,086 | 1/1973 | Weist | 270/61 R |
| 3,952,121 | 4/1976 | Dilo | 28/110 |

FOREIGN PATENT DOCUMENTS

| | | | |
|---|---|---|---|
| 100598 | 7/1962 | Norway | 270/61 R |

*Primary Examiner*—Edgar S. Burr
*Assistant Examiner*—A. Heinz
*Attorney, Agent, or Firm*—Robert K. Youtie

[57] ABSTRACT

A label forming apparatus and method wherein a stack of labels is supported with a rotary mandrel adjacent to one edge margin of the uppermost label, which label is applied to the mandrel and wound thereabout into a tube, which tube is stripped from the mandrel.

17 Claims, 9 Drawing Figures

METHOD AND APPARATUS FOR MANUFACTURE OF ROLLED INFORMATION LABEL

BACKGROUND OF THE INVENTION

The apparatus and method of label forming of the present invention is concerned generally with forming labels of the type disclosed in co-pending patent application Ser. No. 752,446 by James H. Shacklett, Jr. Such formed labels may find the broad utilization in association with drug products, but are not so limited and may be utilized in many varied applications.

The forming of prior labels and information literature required complex folding and/or cutting, involving the use of relatively expensive and slow machinery to cause considerable labor costs.

SUMMARY OF THE INVENTION

It is, therefore, an important object of the present invention to provide highly improved apparatus and method for manufacture of rolled information material which method and apparatus are relatively simple, capable of high speed throughout long continuous periods, for achieving relatively low costs.

It is a further object of the present invention to provide improvements in method and apparatus for forming labels which greatly simplify the label forming procedures over those heretofore known, for enhanced durability and reliability, to substantially reduce rejects, while minimizing initial capital expenditure and maintenance expenses.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

DESCRIPTION OF THE PREFERRED EMBODIMENT

Figure 1:
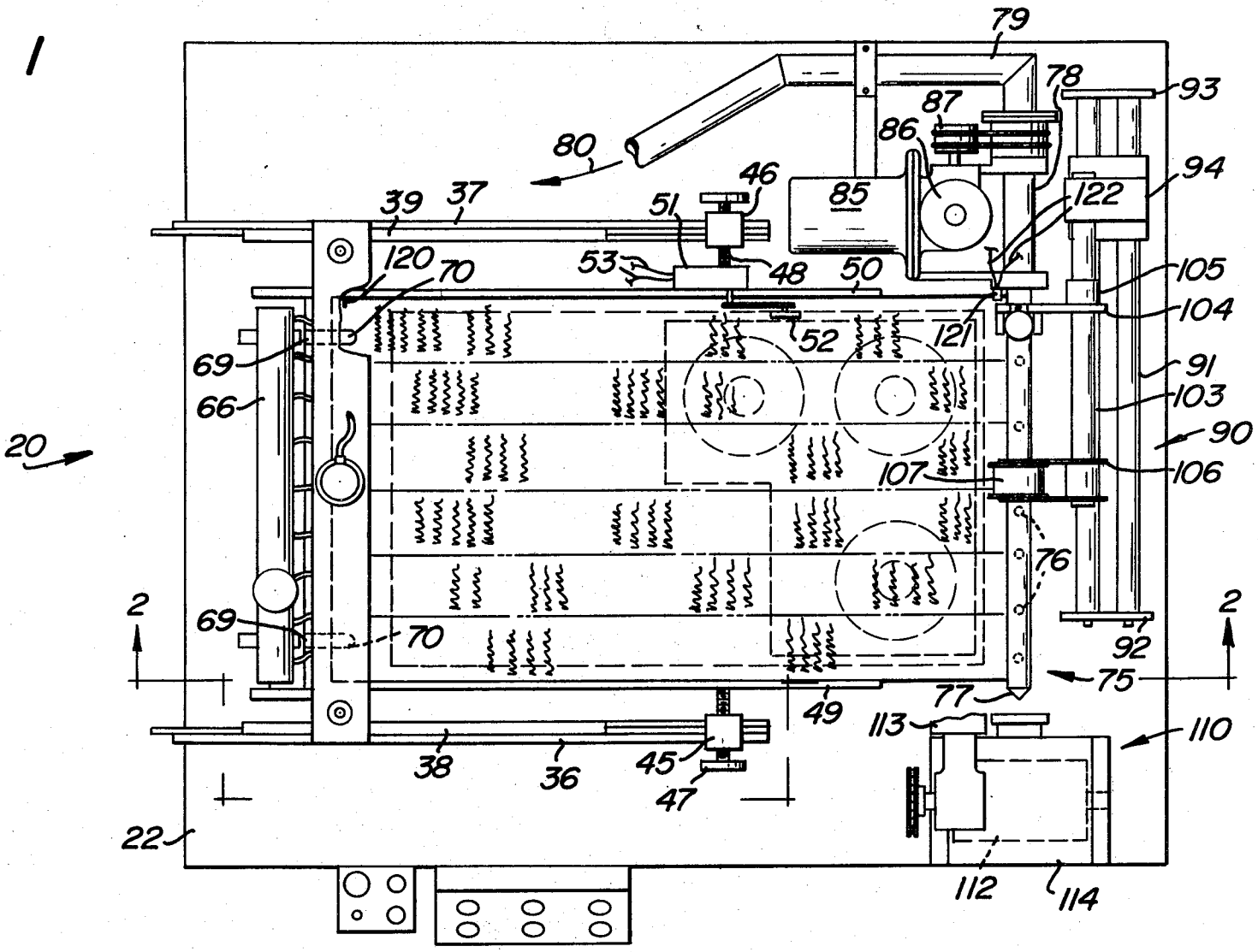
FIG. 1 is a top plan view showing apparatus for label forming in accordance with the teachings of the present invention.
Figure 2:
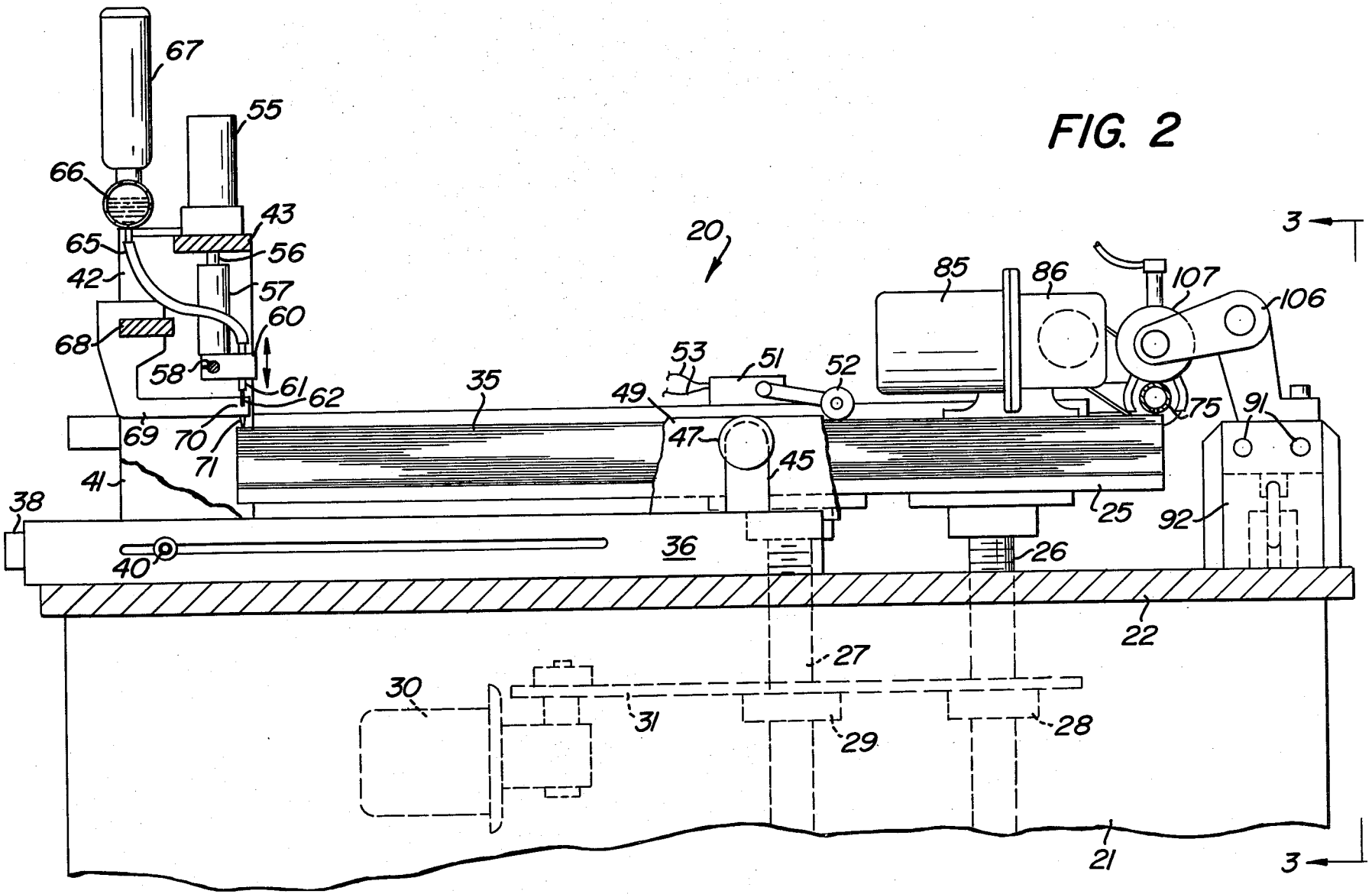
FIG. 2 is a sectional elevational view taken generally along the line 2—2 of FIG. 1.
Figure 3:
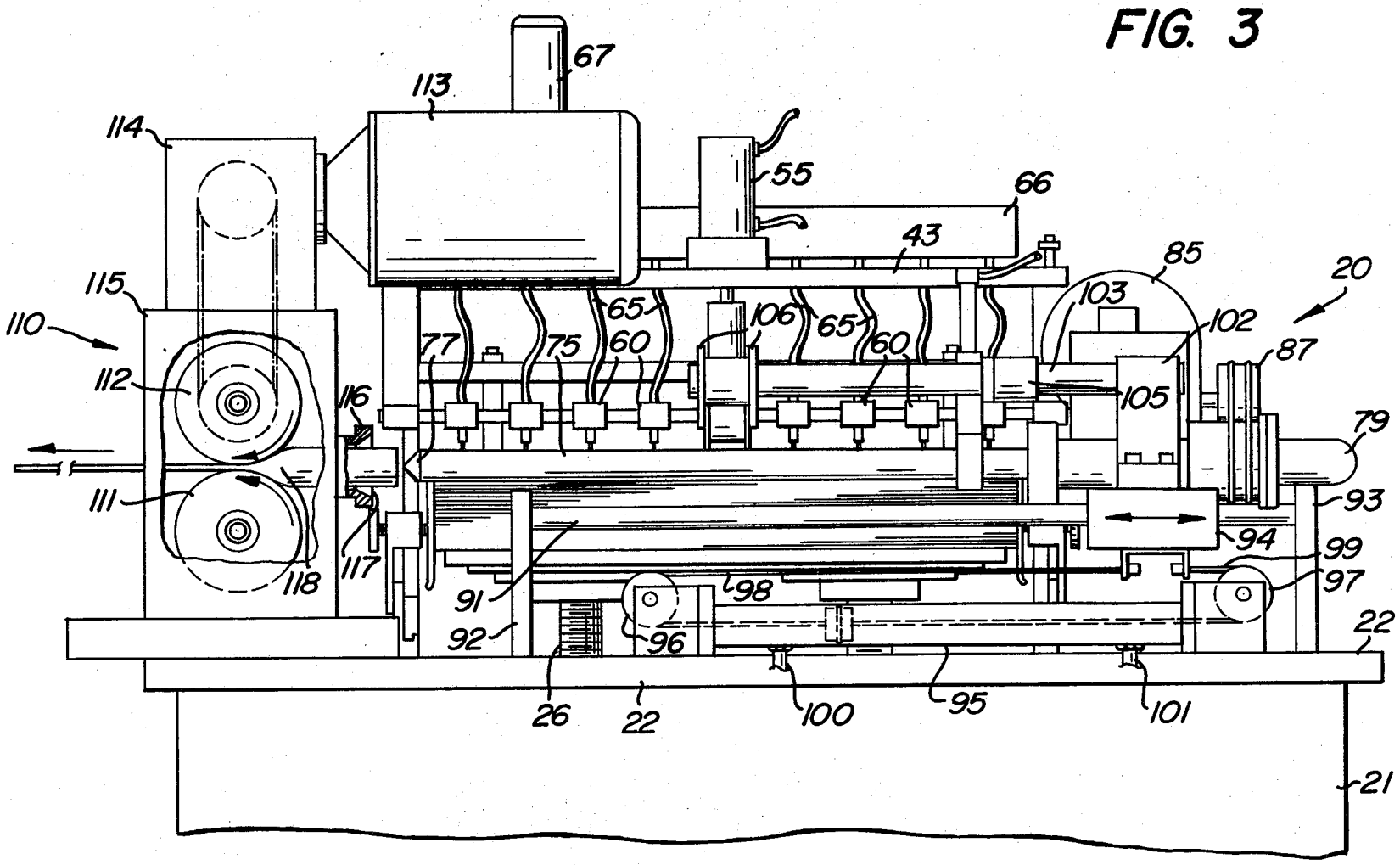
FIG. 3 is an end elevational view taken generally along the line 3—3 of FIG. 2, with parts broken away for clarity.

Referring now more particularly to the drawings, and specifically to FIGS. 1–3 thereof, the label forming apparatus is there generally designated 20, and includes a stand 21 having a top wall 22. Located over a generally central region of the top wall 22 is a generally horizontal table, bed or support 25, such as a suitable rigid plate, which is vertically adjustably supported, as by uprights or standards 26 and 27. Thus, the horizontal support or table 25 and standards 26 and 27 may combine to define an elevator, for purposes appearing more fully hereinafter. The uprights or standards 26 and 27 may be threaded elements depending into the stand 21 and mounted therein constrained to vertical, longitudinal movement, and operatively connected by collars threaded thereabout at 28 and 29, which are constrained to rotative movement, in driven relation with respect to motive means 30 and suitable power transmission means 31. Thus, the table or support 25 defines an elevator for supporting thereon a stack of generally horizontal sheets 35 with the uppermost sheet at a predetermined elevation.

Mounted on the stand top wall 22, in parallel spaced relation with respect to each other and spaced on opposite sides of support plate 25, extending partially there along, are a pair of guide rails or ways 36 and 37. A longitudinally shiftable slide member is adjustably carried in each guideway 36 and 37, as at 38 and 39, respectively. The slides 38 and 39 are slidable longitudinally along their respective guideways 36 and 37 and releasably fixedly positionable there along by any suitable means, such as fasteners or clamps 40. Upstanding from each slide member 38 and 39 is an upright member or strut, as at 41 and 42 and a lateral bridging member 43 extends across and between the upper ends of struts 41 and 42. The bridging member 43 and its side struts or supports 41 and 42 are selectively shiftable, as a unit, along the lengths of guideways 36 and 37 in bridging or spanning relation spaced over the elevator table or stack support 25.

Upstanding from each side rail or guideway 36 and 37, adjacent to the inner end thereof, is a post or upright bracket, as at 45 and 46. A threaded member or screw extends inwardly through each post or bracket 45 and 46, as at 47 and 48, and carries on its inner end a longitudinal stack guide, as at 49 and 50, respectively. The stack guides 49 and 50 are elongate bars for location in facing engagement with opposite longitudinal edges of the label stack 35 to properly locate the stack on support or table 25. Toward this end, the stack guide bars 49 and 50 are carried by respective screws 47 and 48 and shiftable in their parallel facing relation toward and away from each other by rotation of the mounting screws. In addition, one of the stack guide bars, say bar 50, may carry a stack height sensor or switch 51, including a sensing element or finger 52, which sensor is connected, as by electrical conductors 53 to motive means 34 elevating the support table 25 to an upper limiting position as determined by the elevation of sensing finger 52 resting on the uppermost sheet of stack 35.

The bridging framework 41, 42 and 43 may carry on its cross-piece 43 a cylinder 55 having an internal piston and a piston rod 56 depending through the member 43. A depending bar or piston rod extension 57 extends downwardly from the lower end of piston rod 56, and secured to the lower end of extension 57 is a lateral member or rod 58 which extends between and terminates at its opposite ends short of frame side pieces 41 and 42. Carried by the lateral rod 58 and projecting longitudinally inwardly therefrom are a plurality of glue appliers 60, each including a depending nozzle or outlet 61 with a downwardly protruding valve stem or actuator 62. The assembly of lateral member 58 and several glue appliers 60 is vertically shiftable upon up and down movement of piston rod 56 and its extension 57 as controlled by actuation of cylinder 55. Upon downward movement of the several nozzles 61 to engage the actuator 62 with a nether object and thereby raise the actuator relative to its associated nozzle, there is opened an internal valve and thereby dispensed a quantity of glue. Thus, the several glue dispensers 60, lateral mounting member 58 and nozzle 61 may be considered as a vertically shiftable glue head, which upon downward movement into engagement with the uppermost label sheet of stack 35, will apply a series of spots of glue to the uppermost label sheet.

A glue supply conduit or hose 65 is connected at its lower end to each nozzle 61, the upper ends of the several flexible hoses being connected to a supperposed glue distributing manifold 66, which may carry on its upper side a glue reservoir 67. Suitable means may mount the manifold 66 and reservoir 67 in fixed relation while the glue head 60 reciprocates and the several hoses 65 flex.

A lower transverse or bridging member 68 may extend in fixed relation between the side pieces 41 and 42, spaced below the upper bridging member 43, and a plurality of inward or forward extensions 69 may project from the lower bridging member 68 to terminate in free ends 70 over an adjacent portion of the uppermost label sheet of stack 35. There are shown two fingers 69 in the illustrated embodiment, but this number may be more or less, as desired. Depending from the free end 70 of each finger 69 is an impaling element or pointed holding member 71 which pierces through and into the uppermost label sheet 35 and the next adjacent label sheet 35, all for purposes appearing presently.

At the opposite end of stack support table 25, remote from glue head 60, there is provided a generally horizontally disposed, laterally extending hollow or tubular member or mandrel 75. As best seen in FIGS. 1 and 2, the glue head 60 and the several glue nozzles 61 are located over one edge margin of the uppermost label sheet of stack 35. The mandrel 75 is located over the opposite edge margin of the uppermost label sheet. The hollow mandrel 75 is provided along its length with a longitudinal series or row of through apertures or openings 76 communicating with the interior of the mandrel, while one mandrel end 77 is closed, as seen in FIGS. 1 and 3. Remote from the closed mandrel end 77, on one side of the elevator support 25, there is provided a journal bearing 78 mounting the mandrel 75 for axial rotation. A vacuum supply conduit 79 communicates through the journal 78 with the interior of mandrel 75, and communicates at its other end, in the direction of arrow 80, with a vacuum source. Powering the mandrel supporting journal 78 may be a motor 85 having suitable gearing 86 and connected in driving relation with the journal means 78, as by transmission means 87.

Outward of and along the mandrel 75, there is provided on the top wall 22 a stripper assembly, generally designated 90. The assembly includes a pair of laterally extending rails or way means 91 suitably fixedly supported on the top wall 22, as by end plates 92 and 93. A carriage 94 is mounted for back and forth movement along the rails 91. An actuating cylinder-and-piston assembly 95 is mounted on the top wall 22 and includes at opposite ends of the cylinder a pair of pulleys or rolls 96 and 97 about which are trained cables 98 and 99. The respective cables 98 and 99 each has its opposite ends connected to the piston of cylinder 95 and the carriage 94, and is trained about a respective pulley 96, 97. The cylinder 95 is provided with fluid connections 100 and 101 for effecting the desired shifting movement of the piston and carriage 94.

Figure 4:
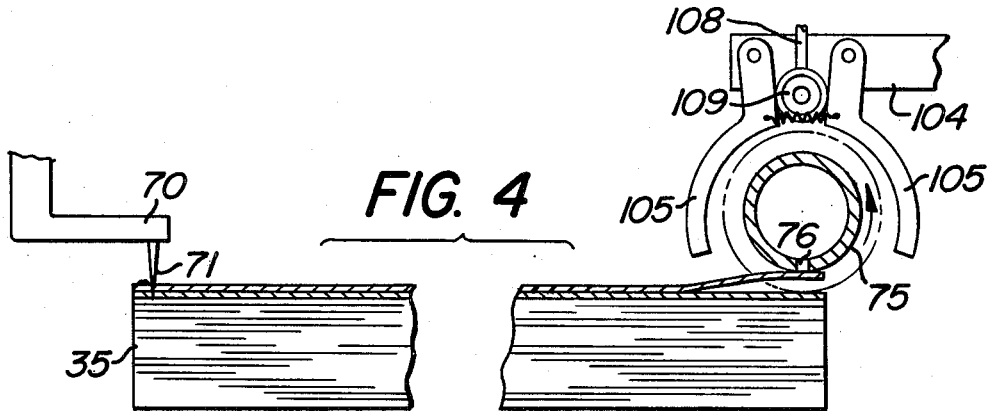
FIG. 4 is a diagrammatic representation of certain parts shown in FIG. 2, enlarged and broken away to facilitate understanding.
Figure 5:
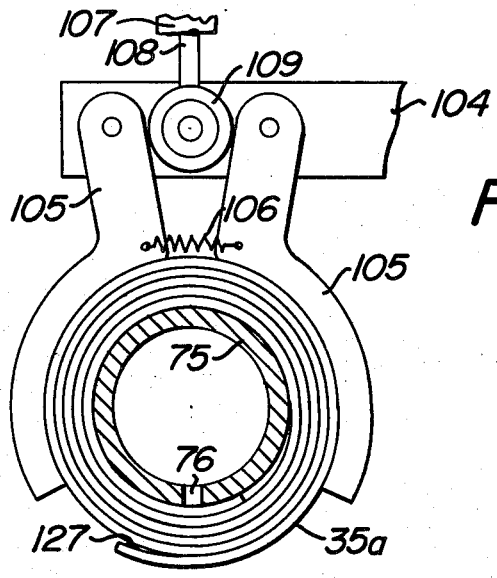
FIG. 5 is a partial sectional view similar to FIG. 4 showing a later stage in operation of the instant method.

The stripping mechanism 90 further includes an upstanding arm or pedestal 102 fixed on the carriage 94, and a shaft or rod 103 extending rigidly from the pedestal 102 in general parallelism with the mandrel 95. A generally horizontal arm 104 is suitably fixed to the rod 103, as by a sleeve 105, and extends outwardly from the rod to a position over the mandrel 75. As best seen in FIGS. 4 and 5, a pair of jaws 105 are pivoted to the arm 104 and depend therefrom onto opposite sides of the mandrel 75. Resilient means, such as a coil tension spring 106 connected between the jaws 105 yieldably urge the latter toward a gripping relation with the mandrel 75. Mounted on the arm 104, upstanding therefrom may be a fluid cylinder 107 having a depending rod 108 provided on its lower end with a cam or roll member 109 engageable between jaws 105 for spreading or opening the latter against the returning force of spring 106.

Also carried on the arm or rod 103, spaced from the arm 104 and jaws 105, is a swingable arm 106 carrying on its outer end a roll 107 adapted to rest on and in rolling engagement with the mandrel 75.

In adjacent spaced aligned relation with the end 77 of mandrel 75, there is provided creasing means, generally designated 110. The creasing means 110 includes a pair of generally tangential rotary members or rolls 111 and 112 having their bight generally aligned with the mandrel 77. Power means, such as a motor 113 may be mounted over the rolls 111 and 112, and in driving relation with the latter through a transmission 114. The rolls may be suitably journaled in a casing or frame 115 which may mount the drive means 113, 114. Also mounted on the casing 115 may be a guide sleeve 116 having one end flared or funnel-like, as at 117 adjacent to the mandrel end 77, for receiving from the mandrel a rolled tube 118 for passage between the creasing rollers 111 and 112 and exit therefrom in creased or folded condition.

In operation, the apparatus 20 automatically maintains the uppermost label sheet of stack 35 at a predetermined elevation, as controlled by the elevation sensing means 51 and elevator support 25. In this predetermined elevation, the holding means or impaling element 71 engage through and into at least the uppermost label sheet and the next adjacent label sheet of stack 35. Also, the uppermost label sheet of the stack is at a controlled elevation adjacent to and spaced slightly below the underside of mandrel 75. With the mandrel 75 rotating in a counter clockwise direction, as viewed in FIG. 2, and vacuum communicated through conduit 79 to the interior of mandrel 75, the edge margin of the uppermost label sheet immediately beneath the mandrel is raised toward and applied to the mandrel, the condition shown in FIG. 4. Continued mandrel rotation serves to wind the uppermost sheet about the mandrel, the uppermost sheet being spaced from the next adjacent sheet for free sliding relative thereto, and the uppermost sheet tearing out of its impaled relation with respect to holding pins 71. The vacuum communicated to the interior of the mandrel 75 may be terminated after a few rotations of the mandrel, and the roll 107 rides on the outermost convolution of sheet being coiled on the mandrel during the coiling to impart a slight drag and assure uniform coiling or wrapping action. Each sheet 35 is provided with a register or control mark 120 which passes beneath a sensor 121 proximate to the mandrel 75 and operates to deactivate the mandrel rotating means, as by de-energizing motor 85. By this register mark 120 and sensing means 121, which may be photo-electric, coiling rotation of the mandrel 75 is terminated at a predetermined angular position, as desired, with respect to the creasing means 110. Thus, the sensor 121, may through suitable conductors 122 and appropriate control means, terminate mandrel rotation. During this winding operation, the stripper jaws have been held open by downward extension of piston rod 108 and cam 109 to the position shown in FIG. 4. Upon cessation of mandrel rotation, fluid means such as pressurized air, may be employed to retract piston rod 108 and cam 109 upward to release the stripper jaws 105 to their gripping relation of FIG. 5 with a label sheet **35*a* wound about the mandrel 75. Also, fluid pressure may be employed to shift carriage 94 toward the creasing means 110, the rolled tube 35*a* thereby being stripped and entering into guide 116 for withdrawal and creasing by rolls 111 and 112**.

Figure 6:
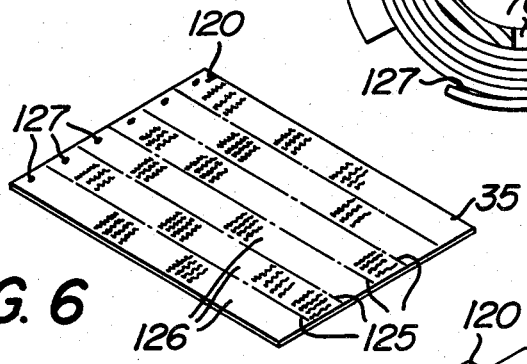
FIG. 6 is perspective view showing a label sheet in an early stage of the instant method.
Figure 7:
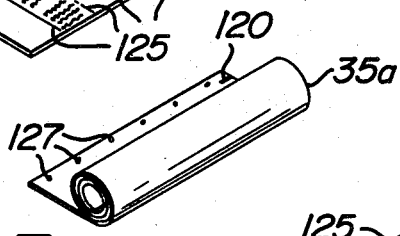
FIG. 7 is a perspective view showing a label sheet in a slightly later stage of the instant method.
Figure 8:
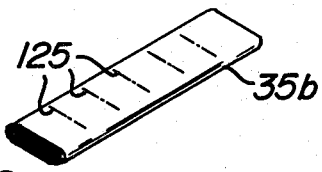
FIG. 8 is a perspective view showing a later stage of label sheet formed in accordance with the teachings of the instant method.

In FIG. 6 is illustrated a label sheet 35 apart from the apparatus and showing a plurality of severance lines 125 subdividing the sheet into a plurality of longitudinally extending strips 126. Along one edge margin of sheet 35 there are provided a plurality of glue spots 127, each in a respective strip 126. The sheet 35 is rolled or coiled about the mandrel 75, as illustrated hereinbefore, to assume the formation of a spiral tube **35*a*, as seen in FIG. 7. In the fully wound condition the glue spots 127 will serve to secure the outermost convolution in position and maintain the tube 35*a* closed. The roll 107 will aid in holding the tube 35*a* closed until the glue spots 127** set.

Figure 9:
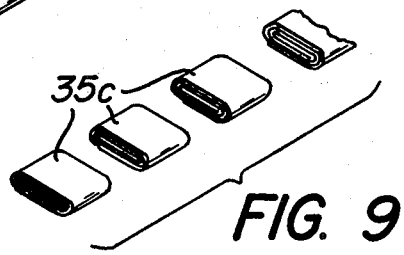
FIG. 9 is a perspective view showing a final stage of the instant method.

Upon stripping of the tube **35*a* and feeding the same through the creasing rolls 111 and 112, there emerges a flattened or creased and rolled label formation 35*b*. Subsequently, the formation 35*b* may be passed to a cutter or slitter and severed along the several severance lines 125 to define a plurality of individual label formations 35*c*, as seen in FIG. 9**.

While the mandrel has been illustrated and described as of a constant generally circular cross section throughout its length, it is appreciated that mandrels of other cross sectional configurations may be employed, as desired. For example, a mandrel may be of oblate, flattened, elipsoidal or polygonal cross section. Such cross sections may serve to initiate creasing action, if desired, or creasing may be eliminated under certain conditions. For example, it may be desired to provide a label sheet formed into a tube of circular or polygonal cross sectional configuration, without flattening, say for circumposition of the tubular label sheet about a container or package of circular or polygonal configuration.

In concluding the above described operational procedure, the carriage 94 may return to its initial position, as illustrated in FIGS. 1–3 and the stripper jaw cylinder 107 actuated to spread the jaws 105, all by a predetermined timed cycle, or other suitable control means, for repetition of the above described operation.

From the foregoing, it is seen that the present invention provides a method and apparatus for label forming which is extremely simple and rapid, and durable and reliable throughout long operating periods, effects considerable savings and costs, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A label-folding apparatus comprising an upwardly facing horizontally fixed support for a stack of labels to be folded, said support being vertically shiftable to locate the uppermost label of a stack at a predetermined level, a mandrel adjacent to said support and fixed vertically for predetermined spacing above said predetermined level for adherently engaging one portion of the uppermost label from a stack on said support to free the uppermost label from the next uppermost label, said mandrel being rotatable for simultaneously drawing the uppermost label across the next uppermost label and rolling the uppermost label into a tube about said mandrel, and creasing rolls having a nip adjacent to one end of said mandrel for rolling engagement in the nip of a tube on said mandrel and simultaneous withdrawal therefrom of a rolled label tube and creasing the same to a flat configuration.

2. A label-folding apparatus according to claim 1, said mandrel being adjacent to one edge margin of said uppermost label, and vacuum means communicable through said mandrel to effect adherence thereto of said one edge margin.

3. A label-folding apparatus according to claim 2, in combination with adhesive applying means spaced from said mandrel for applying adhesive to the label edge margin remote from said one edge margin.

4. A label-folding apparatus according to claim 1, in combination with stripping means for endwise sliding removal of the tube from said mandrel to said creasing rolls.

5. A label-folding apparatus according to claim 1, said support comprising a table for supporting the stack of labels to be folded.

6. A label-folding apparatus according to claim 5, in combination with holding means for holding the label next adjacent to the uppermost label when the uppermost label is drawn across the next uppermost label and rolled.

7. A label-folding apparatus according to claim 6, said holding means comprising an impaling element engageable through said uppermost and next uppermost labels to release the uppermost label by tearing therefrom upon said drawing and rolling while holding the next uppermost label in position.

8. A label-folding apparatus according to claim 1, said creasing rolls comprising a pair of generally tangential rolls extending generally normal to and having their nip adjacent to one end of said mandrel.

9. The method of label folding which comprises: providing a stack of label sheets to be folded, releasably adhering an edge margin of the uppermost label sheet of the stack to a rotary mandrel to simultaneously slide the uppermost label sheet across the next uppermost label sheet and coil the uppermost label sheet about the mandrel to form a mandrel tube, holding said next uppermost label sheet against sliding with the uppermost label sheet by impaling said uppermost and next uppermost label sheets, tearing the uppermost label sheet from said impaled condition upon said sliding, stripping the label tube from the mandrel, and flattening the tube to form a folded label.

10. The method according to claim 9, wherein said one edge margin is adhered to the mandrel by effecting suction in the mandrel directed toward said one edge margin of said uppermost sheet to raise the latter free from the next uppermost sheet.

11. The method according to claim 9, further characterized in sliding the label tube axially relative to the mandrel to effect said stripping.

12. The method according to claim 11, further characterized in feeding one end of a label tube being stripped into the nip of creasing rolls to flatten the tube.

13. A label-forming apparatus comprising an upwardly facing support for a stack of labels to be formed, a rotary mandrel adjacent to and spaced above said support and having its axis fixed horizontally relative to said support, vacuum gripping means associated with said mandrel for gripping engagement with an uppermost label from said stack to simultaneously draw the uppermost label upwardly and horizontally away from the next uppermost label and roll the uppermost label into a tube about said mandrel, said mandrel being fixedly spaced above and adjacent to one edge margin of the stack of labels to be rolled for engagement of said mandrel to said one edge margin of the uppermost label for rolling the uppermost label about said mandrel while drawing the uppermost label upwardly and horizontally from the next uppermost label, and stripping means for axially withdrawing a rolled label tube from the mandrel.

14. A label-forming apparatus comprising an upwardly facing support for a stack of labels to be formed, a rotary mandrel adjacent to and above said support for adherent engagement with an uppermost label from said stack and simultaneously drawing the uppermost label away from the next uppermost label and rolling the uppermost label into a tube about said mandrel, said mandrel being adjacent to one edge margin of the stack of labels to be rolled, vacuum means communicable through said mandrel to effect said adherent engagement thereto of said one edge margin of the uppermost label for rolling of the uppermost label about said mandrel, stripping means for axially withdrawing a rolled label tube from the mandrel, and adhesive applying means spaced from said mandrel for applying adhesive to a label edge margin remote from said one edge margin.

15. A label-forming apparatus comprising an upwardly facing support for a stack of labels to be formed, a rotary mandrel adjacent to and above said support for adherent engagement with an uppermost label from said stack and simultaneously drawing the uppermost label away from the next uppermost label and rolling the uppermost label into a tube about said mandrel, said mandrel being adjacent to one edge margin of the stack of labels to be rolled, vacuum means communicable through said mandrel to effect said adherent engagement thereto of said one edge margin of the uppermost label for rolling of the uppermost label about said mandrel, and stripping means for axially withdrawing a rolled label tube from the mandrel, said support comprising a table for supporting the stack of labels to be formed, said mandrel being over one edge margin of the uppermost label, and holding means for holding the label next adjacent to the uppermost label sheet when the uppermost label is rolled.

16. The method of label-forming which comprises: providing a label sheet to be formed, coiling said label sheet about a mandrel to form a label tube, stripping the label tube from the mandrel, successively providing additional label sheets from a stack of label sheets, successively coiling the uppermost label sheet of the stack about the mandrel to form successive label tubes, and successively stripping the successive label tubes from the mandrel, further characterized in effecting said coiling by applying one edge margin of the uppermost label sheet to the mandrel by effecting suction in the mandrel directed toward the uppermost label sheet, elevating said one edge margin from the next adjacent uppermost sheet upon application to the mandrel to free the uppermost label sheet from the next adjacent uppermost label sheet, and rotating the mandrel to draw the uppermost label sheet across the next adjacent uppermost label sheet and wind the label tube about the mandrel.

17. The method of label folding which comprises: providing a stack of label sheets to be folded, releasably adhering an edge margin of the uppermost label sheet of the stack to a rotary mandrel to simultaneously slide the uppermost label sheet across the next uppermost label sheet and coil the uppermost label sheet about the mandrel to form a label tube, adhering said one edge margin to the mandrel by effecting suction in the mandrel directed toward said one edge margin of said uppermost sheet to raise the latter free from the next uppermost sheet, applying glue to the label sheet at a location remote from said one edge margin to adhesively secure the coiled tube, stripping the label tube from the mandrel, and flattening the tube to form a folded label.

* * * * *